US009613769B2

(12) United States Patent
Gentsch et al.

(10) Patent No.: US 9,613,769 B2
(45) Date of Patent: Apr. 4, 2017

(54) VACUUM INTERRUPTER FOR A CIRCUIT BREAKER ARRANGEMENT

(71) Applicant: ABB Technology AG, Zürich (CH)

(72) Inventors: Dietmar Gentsch, Ratingen (DE); Thierry Delachaux, Zürich (CH); Tarek Lamara, Nussbaumen (CH)

(73) Assignee: ABB Schweiz AG, Baden (CH)

( * ) Notice: Subject to any disclaimer, the term of this patent is extended or adjusted under 35 U.S.C. 154(b) by 29 days.

(21) Appl. No.: 13/849,994

(22) Filed: Mar. 25, 2013

(65) Prior Publication Data

US 2013/0213939 A1 Aug. 22, 2013

Related U.S. Application Data

(63) Continuation of application No. PCT/EP2011/004776, filed on Sep. 23, 2011.

(30) Foreign Application Priority Data

Sep. 24, 2010 (EP) ..... 10010462

(51) Int. Cl.
*H01H 33/38* (2006.01)
*H01H 33/12* (2006.01)
*H01H 33/664* (2006.01)

(52) U.S. Cl.
CPC ..... *H01H 33/38* (2013.01); *H01H 33/12* (2013.01); *H01H 33/6642* (2013.01); *H01H 33/6643* (2013.01)

(58) Field of Classification Search
CPC ..... H01H 33/6641–33/6647; H01H 33/664; H01H 33/38

(Continued)

(56) References Cited

U.S. PATENT DOCUMENTS 3,980,850 A * 9/1976 Kimblin ..... H01H 33/6642 200/279
4,149,050 A * 4/1979 Gorman ..... H01H 33/6642 218/128

(Continued)

FOREIGN PATENT DOCUMENTS

DE 41 17 606 A1 10/1991
DE 41 30 230 A1 3/1993
WO WO 2006/002560 A1 1/2006

OTHER PUBLICATIONS

H. Schellekens, 50 Years of TMF Contacts Design Considerations, 2008, Technical Collection, XXIII ISDEIV, pp. 1, col. 2, lines 2-7.*

(Continued)

*Primary Examiner* — Renee Luebke
*Assistant Examiner* — William Bolton
(74) *Attorney, Agent, or Firm* — Taft Stettinius & Hollister LLP

(57) ABSTRACT

An exemplary vacuum interrupter for a circuit breaker arrangement including a cylindrically shaped insulating part, within which a pair of electrical contact parts are coaxially arranged and surrounded concentrically by the insulating part. The electrical contact parts can be configured to initiate a disconnection arc only between corresponding inner contact elements after starting a disconnection process, and corresponding outer contact elements can be configured to commutate the arc from the inner contact elements to the outer contact elements until the disconnection process is completed, wherein each inner electrical contact element is designed as a TMF-like contact element for generating mainly a transverse magnetic field, and each outer electrical contact element is designed as an AMF-like contact element for generating mainly an axial magnetic field.

4 Claims, 5 Drawing Sheets

(58) Field of Classification Search
USPC ..... 218/118, 123, 130, 140, 127, 128
See application file for complete search history.

(56) References Cited

U.S. PATENT DOCUMENTS

| | | | | | |
|---|---|---|---|---|---|
| 4,210,790 | A * | 7/1980 | Kurosawa et al. | ..... | 218/127 |
| 4,465,991 | A * | 8/1984 | Sakuma et al. | ..... | 335/151 |
| 4,553,002 | A * | 11/1985 | Slade | ..... H01H 33/664 | 218/128 |
| 4,847,456 | A | 7/1989 | Bamford et al. | | |
| 5,099,093 | A * | 3/1992 | Schels | ..... H01H 33/6642 | 218/128 |
| 6,479,778 | B1 * | 11/2002 | Kimura et al. | ..... | 218/118 |
| 6,720,515 | B2 * | 4/2004 | Renz et al. | ..... | 218/136 |
| 7,250,584 | B2 * | 7/2007 | Asmus et al. | ..... | 218/128 |
| 2008/0067151 | A1 | 3/2008 | Steffens et al. | | |

OTHER PUBLICATIONS

International Search Report (PCT/ISA/210) issued on Dec. 23, 2011, by the European Patent Office as the International Searching Authority for International Application No. PCT/EP2011/004776.
Written Opinion (PCT/ISA/237) issued on Dec. 23, 2011, by the European Patent Office as the International Searching Authority for International Application No. PCT/EP2011/004776.
European Search Report for EP 10010462 dated Feb. 11, 2011.

* cited by examiner

VACUUM INTERRUPTER FOR A CIRCUIT BREAKER ARRANGEMENT

RELATED APPLICATION(S)

This application claims priority under 35 U.S.C. §120 to International Application PCT/EP2011/004776 filed on Sep. 23, 2011, designating the U.S., and claiming priority to European application EP 10010462.9 filed in Europe on Sep. 24, 2010. The content of each prior application is hereby incorporated by reference in its entirety.

FIELD

The disclosure relates to a vacuum interrupter, such as a vacuum interrupter for a circuit breaker arrangement, including a cylindrically shaped insulating part within which a pair of electrical contact parts are coaxially arranged and concentrical surrounded by the insulating part, wherein the electrical contact parts comprise means for initiating a disconnection arc only between corresponding inner contact elements after starting a disconnection process, and corresponding outer contact elements comprising means for commutate said arc from the inner contact elements to the outer contact elements until the disconnection process is completed. Furthermore, this disclosure also relates to a medium voltage circuit breaker including at least one of such vacuum interrupter as an insert part.

BACKGROUND INFORMATION

Known vacuum interrupters can be used for medium voltage circuit breakers for applications in the range between 1 and 72 kV of a high current level. These circuit breakers are used in electrical networks to interrupt short circuit currents as well as load currents under difficult load impedances. The vacuum interrupter interrupts the current by creating and extinguishing the arc in a closed vacuum container. Modern vacuum circuit breakers tend to have a longer life expectancy than known air circuit breakers. Nevertheless, exemplary embodiments of the present disclosure are not only applicable to vacuum circuit breakers, but also to modern SF6 circuit breakers having a chamber filled with sulfur hexafluoride gas. Moreover, current interruption with vacuum means is one of the technologies used up to high voltage level. Modern vacuum circuit breakers improve the interruption process substantially through reduced contact travel, reduced contact velocity and small masses of moving electrical contact parts. These electrical contact parts can include special contact element arrangements, which are the subject of the present disclosure.

The U.S. Pat. No. 4,847,456 discloses a vacuum interrupter having a pair of inner electrical contact parts, which are in the form of RMF (Radial Magnetic Field) contact elements, which are surrounded by outer electrical contact elements. The outer electrical contact elements are connected electrically in parallel, and arranged closely adjacent to the inner electrical contact elements. One of the inner electrical contact elements is mounted such that it can move in the axial direction while the corresponding outer electrical contact element is immovably (e.g., stationary) mounted. Both outer electrical contact elements of the corresponding electrical contact parts are in the form of AMF (Axial Magnetic Field) contact elements. During a disconnection process, a contracting, rotating arc is struck between the inner electrical contact elements and is then commutated from the inner to the outer electrical contact elements. This results in the initially contracting arc between changing to a diffuser which burns between the AMF-like electrical contact elements until it is quenched. This solution allows a high disconnecting rate in a vacuum interrupter chamber.

The WO 2006/002560 A1 discloses an electrical contact arrangement and a vacuum interrupter chamber of the type mentioned initially, which also allows an increased switching rate. In particular, a high-short circuit disconnection capacity with a high arc burning voltage is disclosed.

The known contact arrangement for a vacuum interrupter chamber has a pair of inner electrical contact elements which are in the form of RMF contact elements and a pair of outer electrical contact elements. The outer electrical contact elements are connected electrically in parallel with the inner electrical contact elements and are arranged closely adjacent to the inner contact elements. At least one of the inner electrical contact elements is mounted such that it can move axially. The outer electrical contact elements are also in the form of RMF-like contact elements. The inner electrical contact elements are disc-shaped. The inner and the outer electrical contact elements are arranged and designed in such a manner that an arc which is struck during the disconnecting process between the inner electrical contact elements can be commutated entirely or partially between the outer electrical contact elements. That contact arrangement has a low resistance and is able to carry high currents.

As already mentioned, the arc can commutate onto the outer electrical contact elements. Whether one or two arcs burn, depends on the current level. After the disconnection of the initially touching electrical contact elements on load, a concentrated disconnection arc occurs first of all. In the case of an RMF like contact element, as the electrical contact elements open further a contracted arc is formed between the contact pieces. As the contact separation increases further during the course of the disconnecting process, a partial commutation or, with an appropriate physical design, a complete commutation occurs. If the arc—which has been struck between the inner contact pieces—commutates completely onto the outer electrical contact elements, then the interrupter chamber can carry and switch at least the same current as the interrupter chamber with only one RMF-like contact element pair.

The vacuum interrupter chamber which symmetrically surrounds the inner electrical contact parts is cylindrically shaped. One electrical contact part is mounted such that it can axially move while the corresponding electrical contact part is immovably mounted. The outer electrical contact elements of both electrical contact parts are provided with slots, so that they can form an RMF-like contact element. Thus, when a current is flowing through the outer electrical contact elements, a radially magnetic field is produced. The inner electrical contact elements of both corresponding electrical contact parts are also RMF-like contact elements and are provided with slots for the same purpose.

That special electrical contact design increases the production effort substantially. On the other hand it is necessary that the heat arising during the arcing phase is widespread on the electrical contact elements in order to achieve high current interruption performance.

SUMMARY

An exemplary vacuum interrupter for a circuit breaker arrangement is disclosed comprising: a cylindrically shaped insulating part, within which a pair of electrical contact parts are coaxially arranged and surrounded concentrically by the insulating part, wherein the electrical contact parts include means for initiating a disconnection arc only between corresponding inner contact elements after starting a disconnection process, and corresponding outer contact elements include means for commutate said arc from the inner contact elements to the outer contact elements until the disconnection process is completed, wherein each inner electrical contact element is designed as a TMF-like contact element for generating a transverse magnetic field, and each outer electrical contact element is designed as an AMF-like contact element for generating an axial magnetic field, and wherein the outer AMF-like contact element includes an electrical coil for generating the axial magnetic field, and the inner TMF-like contact element has one of a disk, star or spiral shaped form for supporting or generating the transverse magnetic field.

A medium-voltage circuit breaker is disclosed comprising: at least one vacuum interrupter including: a cylindrically shaped insulating part, within which a pair of electrical contact parts are coaxially arranged and surrounded concentrically by the insulating part, wherein the electrical contact parts include means for initiating a disconnection arc only between corresponding inner contact elements after starting a disconnection process, and corresponding outer contact elements include means for commutate said arc from the inner contact elements to the outer contact elements until the disconnection process is completed, wherein each inner electrical contact element is designed as a TMF-like contact element for generating a transverse magnetic field, and each outer electrical contact element is designed as an AMF-like contact element for generating an axial magnetic field, and wherein the outer AMF-like contact element includes an electrical coil for generating the axial magnetic field, and the inner TMF-like contact element has one of a disk, star or spiral shaped form for supporting or generating the transverse magnetic field, the at least one vacuum interrupter being configured for at least one pole part operated by an electromagnetic actuator as switch operation means.

BRIEF DESCRIPTION OF THE DRAWINGS

The foregoing and other aspects of the disclosure will become apparent following the detailed description of the disclosure when considered in conjunction with the enclosed drawings.

DETAILED DESCRIPTION

Figure 1:
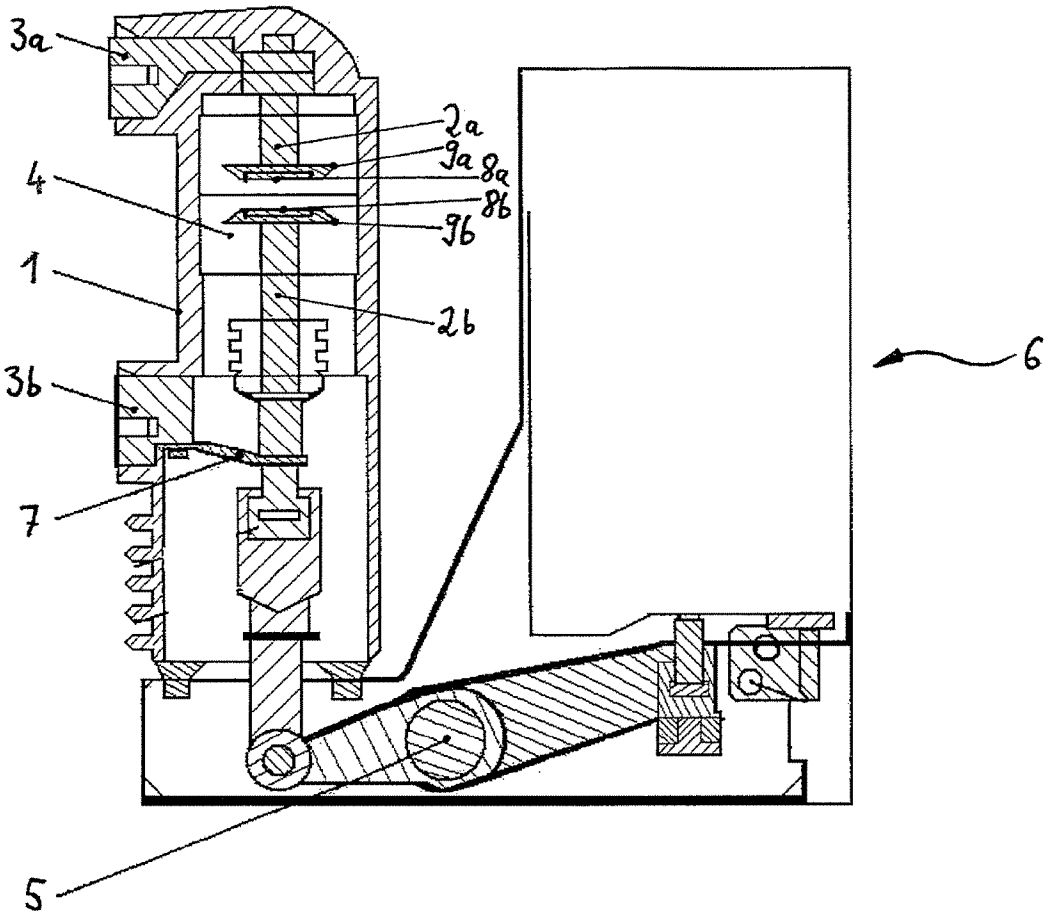
FIG. 1 is a longitudinal section through a medium-voltage circuit breaker having a vacuum interrupter arrangement in accordance with an exemplary embodiment of the present disclosure.

Exemplary embodiments of the present disclosure provide a vacuum interrupter solution for a circuit breaker arrangement with an easy process to manufacture pair of electrical contact parts for a high switching performance.

According to the present disclosure each inner electrical contact element is designed as a TMF (Transverse Magnetic Field) contact element for generating mainly a transverse magnetic field, and each outer electrical contact element is designed as an AMF (Axial Magnetic Field) contact element for generating mainly an axial magnetic field.

The specific combination of these electrical contact elements ensures a high current interruption performance. Moreover, the electrical contact elements according to the present disclosure are relatively easy to manufacture. Furthermore, the special electrical contact element combination provides the electro-physical effect that the heat arising during the arcing phase is widespread on the contact surfaces. Moreover, the life time of a vacuum interrupter including (e.g., comprising) special electrical contact elements according to the present disclosure has a relatively longer life time than known vacuum interrupter since the initial arcing phase and the subsequent arcing phase are decoupled. Due to the lower voltage that can be specified for the arc to sustain on the AMF-like contact element, the arc will always at least partly commutate.

In order to achieve a significant electro-physical effect as described above the outer AMF-contact element of each electrical contact part can include (e.g., comprise) an electrical coil for generating a strong axial magnetic field.

In contrast the inner TMF-like contact element of each electrical contact part can have a disk, butt or pin, spiral- or star-shaped form for at least supporting the transverse magnetic field.

According to an exemplary embodiment of the disclosure the inner electrical contact element of each electrical contact part is coaxially arranged within the corresponding outer electrical contact element, which has a pot-shaped or a tube-shaped geometrical form. Certainly also intermediate forms are possible for that special coaxial arrangement.

Both different electrical contact elements can be attached to a common contact rod as a support element in various ways. According to a first exemplary embodiment, a single contact system is provided. On one electrical contact part, the inner electrical contact element is immovably arranged in relation to the outer electrical contact element and on the other electrical contact part only the inner electrical contact element is moveable arranged in relation to the outer electrical contact element and in relation to the corresponding electrical contact part. Thus, both corresponding outer AMF-like contact elements can be fixed closely adjacent one to another inside the insulating part forming a constant intermediate gap. According to an exemplary embodiment, the inner electrical contact element can be the outer electrical contact element can be separately attached to the distal end of a common contact rod. The contact rod is fixed to the housing of the vacuum interrupter.

According to a second exemplary embodiment a double-contact system is realized in that on both corresponding electrical contact parts the inner electrical contact element is immovably arranged in relation to the outer electrical contact element. At least one of both electrical contact parts is moveable mounted in relation to the surrounding insulating part in order to form an electrical switch operated by manual or automatic switch operation means, as such an electromagnetic actuator.

In order to form a closed vacuum chamber for accommodating the pair of electrical contact parts, the insulating part can include a cover plate on each front side. Both cover plates also serve as a mechanical support for contact rods as mentioned above.

Furthermore, an additional barrel-shaped metal or ceramic shield can be arranged coaxially between the insulating part and the inner pair of electrical contact parts. That shield avoids a formation of a metallic layer on the inside of the inner wall of the insulating part in connection with the special electrical contact pieces according to the present disclosure.

FIG. 1 is a longitudinal section through a medium-voltage circuit breaker having a vacuum interrupter arrangement in accordance with an exemplary embodiment of the present disclosure. The medium voltage circuit breaker as shown in FIG. 1 principally consists of an insulating part 1 of a vacuum interrupter within which a pair of electrical contact parts 2*a*, 2*b* is coaxially arranged. An immovable (e.g., stationary) electrical contact part 2*a* corresponds with a moveable electrical contact part 2*b*. Both electrical contact parts 2*a* and 2*b* have corresponding outer electrical connectors 3*a* and 3*b* respectively and they form an electrical switch for electrical power interruption inside a vacuum chamber 4 of the insulating part 1.

The moveable electrical contact 2*b* is moveable between the closed and the opened position via a jackshaft 5. The jackshaft 5 internally couples the mechanical energy of an electromagnetic actuator 6 to the moving electrical contact 2*b* inside the insulating part 1. In order to ensure an electrical connection between the moveable electrical contact part 2*b* which is moveable attached to the electro-magnetic actuator 6 a flexible connector 7 is provided between said moveable electrical contact part 2*b* and the outer electrical connector 3*b*.

According to an exemplary embodiment disclosed herein, each electrical contact part 2*a* and 2*b* consists of two different kinds of contact elements. An inner electrical contact element 8*a*; 8*b* is designed as a TMF-like contact element and each corresponding outer electrical contact element 9*a*; 9*b* is designed as an AMF-like contact element.

Figure 2:
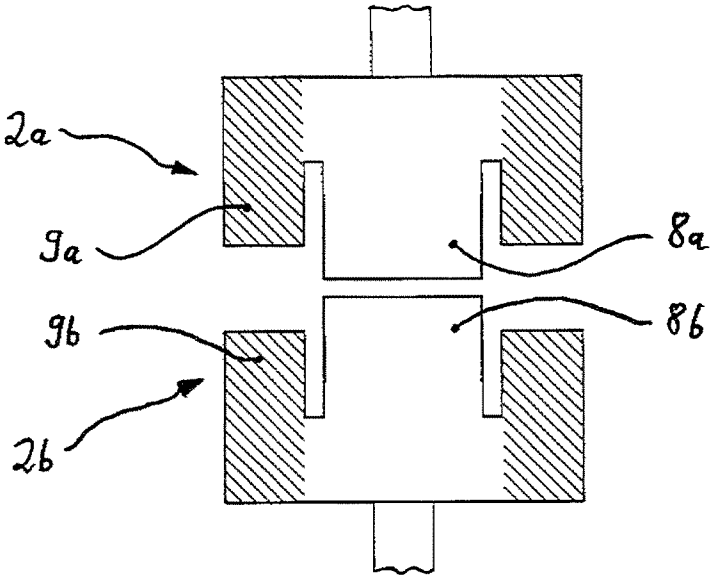
FIG. 2 is a schematic longitudinal section view of a first arrangement of corresponding electrical contact parts in accordance with an exemplary embodiment of the present disclosure.

FIG. 2 is a schematic longitudinal section view of a first arrangement of corresponding electrical contact parts in accordance with an exemplary embodiment of the present disclosure. According to FIG. 2, a double-contact system is realized. On both corresponding electrical contact parts 2*a* and 2*b* the inner electrical contact element 8*a* and 8*b* respectively is immovably arranged in relation to the outer electrical contact element 9*a* and 9*b* respectively. Each inner electrical contact element 8*a*, 8*b* can be coaxially arranged within the corresponding outer electrical contact element 9*a*, 9*b*. The outer electrical contact element 9*a*, 9*b* has a pot-shaped geometrical form in order to accommodate the respective inner electrical contact elements 8*a* and 8*b* ensuring an insulation gap between the inner and the outer electrical contact elements 8*a* and 9*a* or 8*b* and 9*b*.

Figure 3:
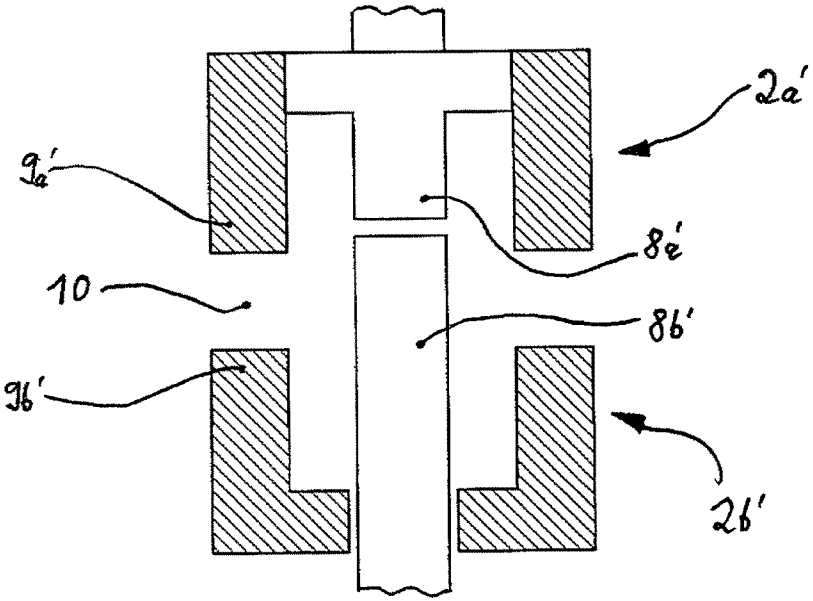
FIG. 3 is a schematic longitudinal section view to a second arrangement of corresponding electrical contact parts in accordance with an exemplary embodiment of the present disclosure.

FIG. 3 is a schematic longitudinal section view to a second arrangement of corresponding electrical contact parts in accordance with an exemplary embodiment of the present disclosure. According to FIG. 3, a single contact system is provided, wherein on one electrical contact part 2*a*' the inner electrical contact element 8*a*' is immovably arranged in relation to the corresponding outer electrical contact element 9*a*'. In contrast, on the other electrical contact part 2*b*' only the inner electrical contact element 8*b*' is moveable arranged in relation to the outer electrical contact element 9*b*' and in relation to the corresponding electrical contact part 2*b*'. Both corresponding outer AMF-like contact elements 9*a*' and 9*b*' are fixed closely adjacent one to another inside the—not shown—insulating part forming a constant intermediate gap 10 which is independent of the switching position of the vacuum interrupter.

Figure 4:
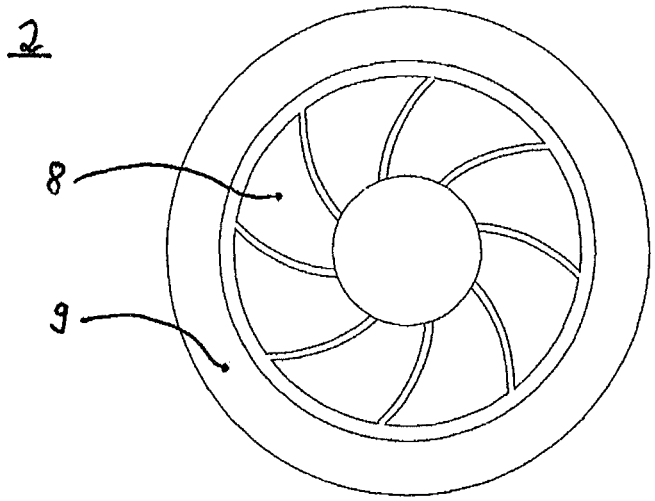
FIG. 4 is a schematic front view on the surface of a first electrical contact element arrangement in accordance with an exemplary embodiment of the present disclosure.

FIG. 4 is a schematic front view on the surface of a first electrical contact element arrangement in accordance with an exemplary embodiment of the present disclosure. As shown in FIG. 4, an electrical contact part 2 has an inner electrical contact element 8 with a spiral-shaped form in a TMF-like geometry for providing the transverse magnetic field. The corresponding outer electrical contact element 9 is ring-shaped in order to provide an axial magnetic field.

Figure 5:
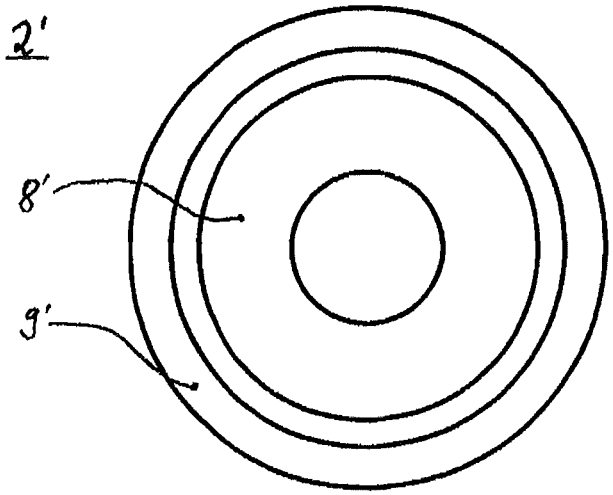
FIG. 5 is a schematic front view on the surface of a second electrical contact element arrangement in accordance with an exemplary embodiment of the present disclosure.
Figure 8:
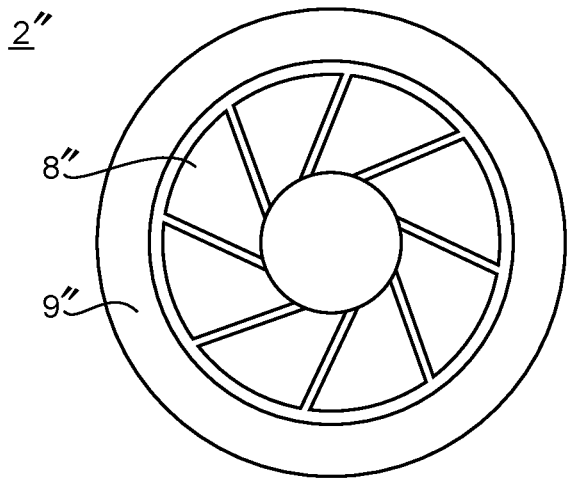
FIG. 8 is a schematic front view on the surface of a third electrical contact element arrangement in accordance with an exemplary embodiment of the present disclosure.

FIG. 5 is a schematic front view on the surface of a second electrical contact element arrangement in accordance with an exemplary embodiment of the present disclosure. As shown in FIG. 5, an electrical contact part 2' has an inner TMF-like contact element 8' with a plane-shaped form, or disk-shaped form, which corresponds to an outer AMF-like electrical contact element 9' which is identical to the foregoing described embodiment. Alternatively, as shown in FIG. 8, the electrical contact part 2" may have an inner electrical contact element 8" with a star-shaped form. The corresponding outer electrical contact element 9" may be identical to the foregoing described embodiments.

Figure 6:
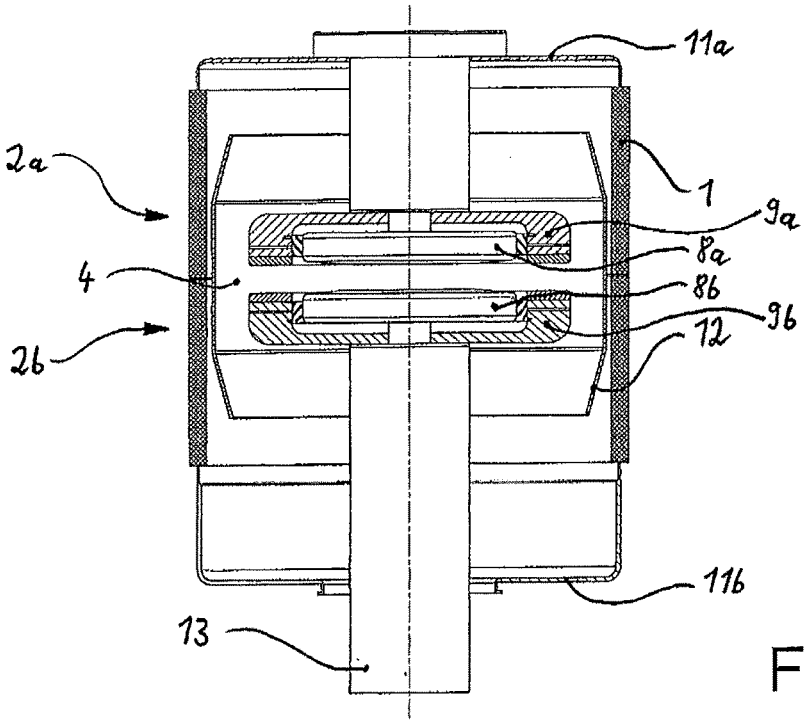
FIG. 6 is a longitudinal section view to a double contact system of vacuum interrupter in accordance with an exemplary embodiment of the present disclosure.

FIG. 6 is a longitudinal section view to a double contact system of vacuum interrupter in accordance with an exemplary embodiment of the present disclosure. As shown in FIG. 6 the cylindrically-shaped insulating part 1 of the vacuum interrupter comprises cover plates 11*a* and 11*b* which are arranged on both front sides of the insulating part 1 in order to form a closed vacuum chamber 4. Inside the vacuum chamber 4 a pair of electrical contact parts 2*a* and 2*b* is arranged. The first electrical contact part 2*a* is fixed in relation to the insulating part 1. The corresponding electrical contact part 2*b* is moveably arranged in relation to the insulating part 1 in order to form an electrical switch. For moving the electrical contact part 2*b* the corresponding contact rod 13 is operated by a—not shown—electromagnetic actuator. Furthermore, a barrel-shaped metal shield 12 can be coaxially arranged inside the vacuum chamber 4.

A double contact system is provided which consists of inner electrical contact elements 8*a* and 8*b* respectively which are immovably arranged in relation to corresponding outer electrical contact elements 9*a* and 9*b*, respectively. The outer electrical contact elements 9*a* and 9*b* have a pot-shaped geometrical form in order to accommodate the corresponding inner electrical contact elements 8*a* and 8*b* respectively in an insulated manner.

Figure 7:
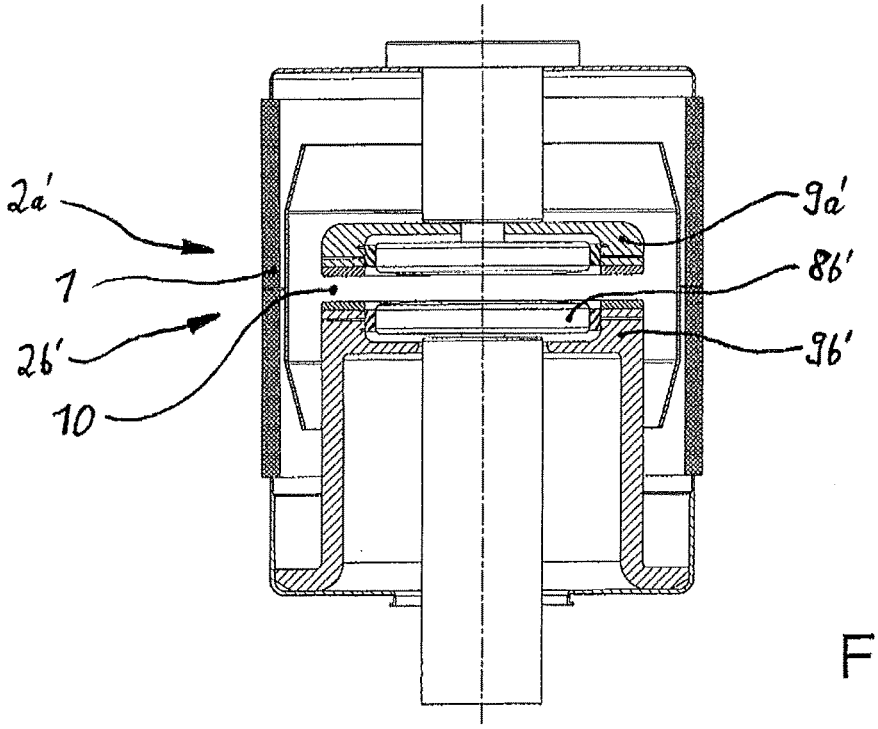
FIG. 7 is a longitudinal section view to a single contact system of vacuum interrupter in accordance with an exemplary embodiment of the present disclosure.

FIG. 7 is a longitudinal section view to a single contact system of vacuum interrupter in accordance with an exemplary embodiment of the present disclosure. As shown in FIG. 7, a single contact system is illustrated, in which the upper electrical contact part 2*a*' is immovably mounted in relation to the insulating part 1. In contrast, on the other electrical contact part 2*b*' only the inner electrical contact element 8*b*' is moveably arranged in relation to its corresponding outer electrical contact element 9*b*'. Thus, for electrically switching, only the inner electrical contact element 8$b'$ moves axially. Between the corresponding outer electrical contact elements 9$a'$ and 9$b'$ a constant intermediate gap 10 is provided.

When the inner electrical contact elements 8$a'$, 8$b'$ are in closed position, the load current flows through them with low contact resistance. For current interruption, the initial arc is generated between the inner TMF-like contact elements 8$a'$, 8$b'$ and develops shortly in transition modes as in standard spiral TMF-like contact elements depending on the current level. At low current the arc column expands in diffuse mode with increasing the gap distance and the instantaneous current as well. At high current, the generated transverse magnetic field by the spirals makes the constricted arc rotating shortly between the inner contacts elements 8$a'$, 8$b'$. The arc should reach the inter-electrode gap between inner and outer contacts after a short time of a few milliseconds, and then supposed to commutate entirely to the outer AMF-like contact elements 9$a'$ and 9$b'$ and remains in diffuse mode until the arc extinction. This idea is supported by the fact that the arc voltage drop through AMF-like contact elements 9$a'$ and 9$b'$ is distinctly smaller than through TMF-like contact elements 8$a'$ and 8$b'$.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE LIST

1 insulating part
2 electrical contact part
3 electrical connector
4 vacuum chamber
5 jackshaft
6 electromagnetic actuator
7 flexible connector
8 inner contact element
9 outer contact element
10 intermediate gap
11 cover plate
12 shield
13 contact rod

What is claimed is:

1. A vacuum interrupter for a circuit breaker arrangement comprising:

a cylindrically shaped insulating part, within which a pair of electrical contact parts are coaxially arranged and surrounded concentrically by the insulating part, wherein the electrical contact parts include means for initiating a disconnection arc only between corresponding inner electrical contact elements after starting a disconnection process, and corresponding outer electrical contact elements include means for commutating said arc from the inner electrical contact elements to the outer electrical contact elements until the disconnection process is completed, wherein each inner electrical contact element is designed for generating a transverse magnetic field, and each outer electrical contact element is designed for generating an axial magnetic field, wherein each outer electrical contact element includes an electrical coil for generating the axial magnetic field, and each inner electrical contact element has one of a disk, star or spiral shaped form for supporting or generating the transverse magnetic field, wherein for a double-contact system on both corresponding electrical contact parts the inner electrical contact element is immovably arranged in relation to the outer electrical contact element, and one of the electrical contact parts is movable in relation to the other electrical contact part for a switching function;

wherein each inner electrical contact element is coaxially arranged within a corresponding outer electrical contact element, which has a pot-shaped or a tube-shaped geometrical form, and an insulation gap is established between each inner and each outer electrical contact elements, wherein each inner electrical contact element and each outer electrical contact element are integrated to form the electrical contact element, wherein each insulation gap is formed only between adjacent lateral edges of each inner and each outer electrical contact elements.

2. The vacuum interrupter according to claim 1, wherein the insulating part includes a cover plate on each front side in order to form a closed vacuum chamber for accommodation the pair of electrical contact parts.

3. The vacuum interrupter according to claim 1, wherein an additional barrel-shaped metal or ceramic shield is coaxially arranged between the insulating part and the pair of electrical contact parts.

4. A medium-voltage circuit breaker comprising:

at least one vacuum interrupter including:

a cylindrically shaped insulating part, within which a pair of electrical contact parts are coaxially arranged and surrounded concentrically by the insulating part, wherein the electrical contact parts include means for initiating a disconnection arc only between corresponding inner electrical contact elements after starting a disconnection process, and corresponding outer electrical contact elements include means for commutating said arc from the inner electrical contact elements to the outer electrical contact elements until the disconnection process is completed, wherein each inner electrical contact element is designed for generating a transverse magnetic field, and each outer electrical contact element is designed for generating an axial magnetic field, and wherein each outer electrical contact element includes an electrical coil for generating the axial magnetic field, and each inner electrical contact element has one of a disk, star or spiral shaped form for supporting or generating the transverse magnetic field, the at least one vacuum interrupter being configured for at least one pole part operated by an electromagnetic actuator as switch operation means, wherein for a double-contact system on both corresponding electrical contact parts the inner electrical contact element is immovably arranged in relation to the outer electrical contact element, and one of the electrical contact parts is movable in relation to the other electrical contact part for a switching function;

wherein each inner electrical contact element is coaxially arranged within a corresponding outer electrical contact element, which has a pot-shaped or a tube-shaped geometrical form, and an insulation gap is established between each inner and each outer electrical contact elements, wherein each inner electrical contact element and each outer electrical contact element are integrated to form the electrical contact element, and wherein the insulation gap is formed only between adjacent lateral edges of each inner and each outer electrical contact elements.

* * * * *